US012404458B2

(12) United States Patent
Timken et al.

(10) Patent No.: US 12,404,458 B2
(45) Date of Patent: Sep. 2, 2025

(54) PROCESS FOR STABLE BLEND OF WASTE PLASTIC WITH PETROLEUM FEED FOR FEEDING TO OIL REFINERY UNITS AND PROCESS OF PREPARING SAME

(71) Applicant: Chevron U.S.A. Inc., San Ramon, CA (US)

(72) Inventors: Hye-Kyung C. Timken, San Ramon, CA (US); Joel E. Schmidt, San Ramon, CA (US); Tengfei Liu, San Ramon, CA (US)

(73) Assignee: Chevron U.S.A. Inc., San Ramon, CA (US)

( * ) Notice: Subject to any disclaimer, the term of this patent is extended or adjusted under 35 U.S.C. 154(b) by 130 days.

(21) Appl. No.: 18/349,333

(22) Filed: Jul. 10, 2023

(65) Prior Publication Data

US 2024/0191142 A1 Jun. 13, 2024

Related U.S. Application Data

(60) Provisional application No. 63/387,038, filed on Dec. 12, 2022.

(51) Int. Cl.
*C10G 1/10* (2006.01)
*C10G 1/00* (2006.01)

(52) U.S. Cl.
CPC ..... *C10G 1/10* (2013.01); *C10G 1/002* (2013.01); *C10G 2300/1003* (2013.01);
(Continued)

(58) Field of Classification Search
None
See application file for complete search history.

(56) References Cited

U.S. PATENT DOCUMENTS 3,845,157 A 10/1974 Woo
4,108,730 A 8/1978 Chen et al.
(Continued)

FOREIGN PATENT DOCUMENTS

CN 107434979 A 12/2017
EP 0 620 264 A2 10/1994
EP 1 707 614 A 4/2006
EP 3 878 926 A1 9/2021

OTHER PUBLICATIONS

International Preliminary Report on Patentability issued in related International Patent Application No. PCT/US2023/016869, Sep. 24, 2024.
(Continued)

*Primary Examiner* — Tam M Nguyen
(74) *Attorney, Agent, or Firm* — E. Joseph Gess; Melissa M. Hayworth; Terrence M. Flaherty

(57) ABSTRACT

Provided is a blend of a petroleum feedstock and 1-20 wt. % of plastic, based on the weight of the blend, with the plastic comprising polyethylene and/or polypropylene, and the plastic in the blend comprising finely dispersed microcrystalline particles having an average particle size of 10 micron to less than 100 microns, and less than 10 ppm chloride. A process for preparing a blend of plastic and petroleum is provided, comprising mixing together a petroleum feed and a plastic comprising polyethylene and/or polypropylene and heating the mixture above the melting point of the plastic, but less than 500° F. The blend mixture is then hot filtered with the resulting filtered blend mixture being heated to at least 500° F. The heated mixture can then be treated with a chloride removal guard bed. The resulting blend can then be cooled and stored or sent directly to a refinery conversion unit.

23 Claims, 6 Drawing Sheets

(52) U.S. Cl.
CPC ..... *C10G 2300/1092* (2013.01); *C10G 2300/201* (2013.01); *C10G 2300/4006* (2013.01)

(56) References Cited

U.S. PATENT DOCUMENTS

| | | | | |
|---|---|---|---|---|
| 4,118,281 | A | 10/1978 | Yan | |
| 4,642,401 | A | 2/1987 | Coenen et al. | |
| 4,721,824 | A | 1/1988 | McWilliams et al. | |
| 5,849,964 | A | 12/1998 | Holighaus et al. | |
| 5,866,501 | A * | 2/1999 | Pradhan | C10G 1/086 208/143 |
| 6,143,940 | A | 11/2000 | Miller et al. | |
| 6,150,577 | A | 11/2000 | Miller et al. | |
| 6,288,296 | B1 | 9/2001 | Miller et al. | |
| 6,774,272 | B2 | 8/2004 | Miller | |
| 6,822,126 | B2 | 11/2004 | Miller | |
| 7,834,226 | B2 | 11/2010 | Miller | |
| 8,088,961 | B2 | 1/2012 | Miller | |
| 8,404,912 | B1 | 3/2013 | Miller | |
| 8,696,994 | B2 | 4/2014 | Miller | |
| 11,359,147 | B2 | 6/2022 | Timken | |
| 11,421,162 | B2 | 8/2022 | Pradeep et al. | |
| 2008/0128325 | A1 | 6/2008 | Khan et al. | |
| 2016/0264885 | A1 | 9/2016 | Narayanaswamy et al. | |
| 2016/0362609 | A1 | 12/2016 | Ward et al. | |
| 2018/0201847 | A1 | 7/2018 | Kohli et al. | |
| 2019/0161683 | A1 | 5/2019 | Narayanaswamy et al. | |
| 2020/0172716 | A1 | 6/2020 | Pehlert et al. | |
| 2020/0331169 | A1 * | 10/2020 | Roodman | B01D 11/0488 |
| 2021/0087473 | A1 | 3/2021 | Pradeep et al. | |
| 2021/0130699 | A1 | 5/2021 | Bitting et al. | |
| 2021/0189250 | A1 | 6/2021 | Timken | |
| 2021/0189252 | A1 | 6/2021 | Timken | |
| 2021/0189254 | A1 | 6/2021 | Timken | |
| 2021/0332300 | A1 | 10/2021 | Timken | |
| 2022/0041940 | A1 | 2/2022 | Pradeep et al. | |
| 2023/0212370 | A1 * | 7/2023 | DeBruin | C08J 11/22 521/48.5 |
| 2023/0220181 | A1 * | 7/2023 | DeBruin | C08J 11/24 521/48 |
| 2023/0312863 | A1 * | 10/2023 | Timken | C10G 1/10 |
| 2023/0357644 | A1 * | 11/2023 | Li | C08J 11/16 |
| 2023/0416612 | A1 * | 12/2023 | Adam | C10G 69/06 |
| 2024/0010583 | A1 * | 1/2024 | Schmidt | C10G 51/04 |
| 2024/0010928 | A1 * | 1/2024 | Schmidt | C10G 1/10 |
| 2024/0010940 | A1 * | 1/2024 | Liu | C10G 1/10 |

OTHER PUBLICATIONS

International Search Report and Written Opinion issued in related International Patent Application No. PCT/US2023/016853, Jul. 11, 2023.

International Preliminary Report on Patentability issued in related International Patent Application No. PCT/US2023/016853, Sep. 24, 2024.

International Search Report and Written Opinion issued in related International Patent Application No. PCT/US2023/016833, Jun. 30, 2023.

International Preliminary Report on Patentability issued in related International Patent Application No. PCT/US2023/016833, Sep. 24, 2024.

International Search Report and Written Opinion issued in related International Patent Application No. PCT/US2023/016839, Jul. 5, 2023.

International Preliminary Report on Patentability issued in related International Patent Application No. PCT/US2023/016839, Sep. 24, 2024.

International Search Report and Written Opinion issued in related International Patent Application No. PCT/US2023/016850, Jul. 3, 2023.

International Preliminary Report on Patentability issued in corresponding International Patent Application No. PCT/US2023/016850, Sep. 24, 2024.

International Search Report and Written Opinion issued in related International Patent Application No. PCT/US2023/016857, Jul. 20, 2023.

International Preliminary Report on Patentability issued in related International Patent Application No. PCT/US2023/016857, Sep. 24, 2024.

International Search Report and Written Opinion issued in related International Patent Application No. PCT/US2023/016862, Jul. 11, 2023.

International Preliminary Report on Patentability issued in related International Patent Application No. PCT/US2023/016862, Sep. 24, 2024.

International Search Report and Written Opinion issued in related International Patent Application No. PCT/US2023/016869, Jul. 20, 2023.

International Search Report and Written Opinion issued in related International Patent Application No. PCT/US2023/079864, Nov. 14, 2023.

International Search Report and Written Opinion issued in related International Patent Application No. PCT/US2023/069871, Nov. 14, 2023.

International Search Report and Written Opinion issued in related International Patent Application No. PCT/US2023/069874, Nov. 16, 2023.

International Search Report and Written Opinion issued in related International Patent Application No. PCT/US2023/069862, Jan. 18, 2024.

International Search Report and Written Opinion issued in related International Patent Application No. PCT/US2023/069881, Nov. 16, 2023.

International Search Report and Written Opinion issued in corresponding International Patent Application No. PCT/US2023/069876, Nov. 16, 2023.

* cited by examiner

PROCESS FOR STABLE BLEND OF WASTE PLASTIC WITH PETROLEUM FEED FOR FEEDING TO OIL REFINERY UNITS AND PROCESS OF PREPARING SAME

CROSS REFERENCE TO RELATED APPLICATIONS

This application claims priority to U.S. Provisional Application Ser. No. 63/387,038 filed Dec. 12, 2022, the complete disclosure of which is incorporated herein by reference in its entirety.

BACKGROUND

The world has seen extremely rapid growth of plastics production. According to PlasticEurope Market Research Group, the world's plastics production was 335 million tons in 2016, 348 million tons in 2017 and 359 million tons in 2018. According to Mckinsey & Company, the global plastics-waste volume was estimated about 260 million tons per year in 2016 and projected to be 460 million tons per year by 2030 if the current trajectory continues.

Single use plastic waste has become an increasingly important environmental issue. At the moment, there appear to be few options for recycling polyethylene and polypropylene waste plastics to value-added chemicals and fuel products. Currently, only a small amount of polyethylene/polypropylene is recycled via chemical recycling, where recycled and cleaned plastic pellets are pyrolyzed in a pyrolysis unit to make fuels (naphtha, diesel), steam cracker feed or slack wax. The majority, greater than 80%, is incinerated, land filled or discarded.

The current method of chemical recycling via pyrolysis cannot make a big impact for the plastics industry. The current pyrolysis operation produces poor quality fuel components (naphtha and diesel range products), but the quantity is small enough that these products can be blended into fuel supplies. However, this simple blending cannot continue if we have to recycle very large volumes of waste polyethylene and polypropylene to address the environmental issues. The products as produced from the pyrolysis unit have too poor quality to be blended in large amounts (for example 5-20 volume % blending) in transportation fuels.

Processes are known which convert waste plastic into hydrocarbon lubricants. For example, U.S. Pat. No. 3,845,157 discloses cracking of waste or virgin polyolefins to form gaseous products such as ethylene/olefin copolymers which are further processed to produce synthetic hydrocarbon lubricants. U.S. Pat. No. 4,642,401 discloses the production of liquid hydrocarbons by heating pulverized polyolefin waste at temperatures of 150-500° C. and pressures of 20-300 bars. U.S. Pat. No. 5,849,964 discloses a process in which waste plastic materials are depolymerized into a volatile phase and a liquid phase. The volatile phase is separated into a gaseous phase and a condensate. The liquid phase, the condensate and the gaseous phase are refined into liquid fuel components using standard refining techniques. U.S. Pat. No. 6,143,940 discloses a procedure for converting waste plastics into heavy wax compositions. U.S. Pat. No. 6,150,577 discloses a process of converting waste plastics into lubricating oils. EP0620264 discloses a process for producing lubricating oils from waste or virgin polyolefins by thermally cracking the waste in a fluidized bed to form a waxy product, optionally using a hydrotreatment, then catalytically isomerizing and fractionating to recover a lubricating oil.

U.S. Pub. No. 2021/0130699 discloses processes and systems for making recycle content hydrocarbons from recycled waste material. The recycle waste material is pyrolyzed to form a pyrolysis oil composition, at least a portion of which may then be cracked to form a recycle olefin composition.

Other documents which relate to processes for converting waste plastic into lubricating oils include U.S. Pat. Nos. 6,288,296; 6,774,272; 6,822,126; 7,834,226; 8,088,961; 8,404,912 and 8,696,994; and U.S. Patent Application Publication Nos. 2019/0161683; 2016/0362609; and 2016/0264885. The foregoing patent documents are incorporated herein by reference in their entirety.

Globally, recycling or upcycling of plastic waste has gained great interest to save resources and the environment. Mechanical recycling of plastic waste is rather limited due to different types, properties, additives, and contaminants in the collected plastics. Usually, the recycled plastics are of degraded quality. Chemical recycling to the starting material or value-added chemicals has emerged as a more desirous route.

However, in order to achieve chemical recycling of single use plastics in an industrially significant quantity to reduce its environmental impact, more robust processes are needed. Such a process may require unique handing and manipulation of the waste plastic. If the plastics are to be used in preparing a feed to a refinery, of particular concern is the presence of chloride. Refinery units have low chloride tolerances. Chlorides in feed stream may cause corrosion of refinery equipment and vessels, and may produce poor quality fuels and chemicals.

SUMMARY

In one embodiment, provided is a composition of a stable blend of waste plastic and a petroleum based feedstock for direct conversion of waste plastic in a refinery process unit. In one embodiment, the blend comprises less than 100 ppm chloride. In another embodiment, the blend comprises less than 10 ppm chloride. In another embodiment, the blend comprises less than 5 ppm chloride.

The stable blend comprises a petroleum based feedstock and 1-20 weight % of plastic. The plastic, in one embodiment, is comprised of mostly polyethylene and/or polypropylene. The plastic in the blend is present as finely dispersed microcrystalline particles having an average particle size of 10 micron to less than 100 microns, preferentially less than 80 microns. The blend can also comprise less than 5 ppm chloride.

Also provided in one embodiment is a process for preparing a blend of plastic and petroleum. The process comprises mixing a petroleum based feed, or in one embodiment a bio-feed, and a plastic together, and heating the mixture above the melting point of the plastic, but not greater than 500° F. In one embodiment, the mixture is heated to a temperature of 250-450° F. In one embodiment, the heating can be for a residence time of 5-240) minutes. The product is then filtered hot to remove any contaminants including glass, metal, PVC or other plastics with a low solubility such as polystyrene (PS), polyethylene terephthalate (PETE) and other Group 7 plastics. The resulting filtered blend of feedstock and plastic is then heated to 500° to 800° F. (260° to 427° C.), preferentially 550° to 700° F. (288° to 371° C.) to decompose any residual PVC while keeping the polyethylene and polypropylene intact. Any offgas containing HCl and volatile organic chlorides is treated with a scrubber. A stripping gas such as nitrogen, hydrogen, steam, or offgas from a conversion unit may be fed to the heating device to facilitate the HCl offgas removal from the liquid. If needed, the resulting liquid product is treated further with a chloride removal guard bed catalyst. The resulting blend comprises less than 100 ppm chloride, and more preferably less than 10 ppm chloride. The blend can then be fed to a refinery unit or cooled to a temperature below the melting point of the plastics and stored for subsequent feeding to a refinery and/or transportation.

Among other factors, the present process prepares a blend of plastic and a petroleum based feedstock which contains minimal, if any, chloride, e.g., in one embodiment less than 10 ppm chloride, or even less than 5 ppm chloride. The blend is close to, if not essentially, free of chloride. The present process also provides a simple process where most of the chloride is removed by filtration. This essentially chloride free blend of plastic and petroleum based feedstock provides a vehicle to efficiently and effectively feed waste plastic to refinery processes for conversion of the waste plastic to high volume products, with good yields. It has been found that by preparing the present blend and feeding the blend to refinery operations, one can efficiently, effectively, and safely recycle plastic waste while also complementing the operation of a refinery in the preparation of higher value products such as gasoline, jet fuel, base oil, and diesel fuel. Polyethylene and polypropylene can also be produced from the waste plastics efficiently and effectively. In fact, positive economics are realized for the overall recycling process with product quality identical to that of virgin polymer. The use of the present blend also saves energy and is more environmentally friendly than prior recycling processes. The minimal, if any, chloride contained in the blend allows the blend to be safely passed through a refinery without damaging the equipment and refinery units, as the present art discloses a process for reducing the chloride contents to levels that fall below unit operating limits. In one embodiment, the feedstock with which the plastic is mixed can comprise a bio-feed. The bio-feed can be used alone or in combination with the petroleum based feedstock.

DETAILED DESCRIPTION

Figure 1:
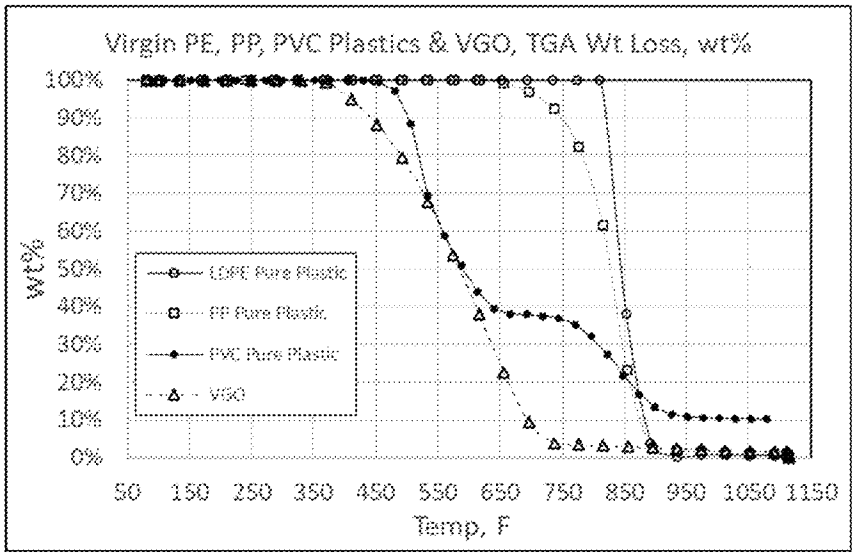
FIG. 1 graphically shows Thermal Gravimetric Analysis (TGA) results for pure polyethylene (PE), polypropylene (PP) and polyvinyl chloride (PVC) plastics and Vacuum Gas Oil (VGO).

Disclosed are a novel plastic and petroleum based feedstock blend, and a process to prepare a stable blend of a plastic and a petroleum based feedstock comprising minimal, if any, chloride, metals and other plastic contaminants for direct conversion of plastic in a refinery process unit. In one embodiment, the feedstock mixed with the plastic can comprise a bio-feed feedstock. The bio-feed can comprise the entire feedstock, or can be used in combination with a petroleum based feedstock.

In one embodiment, provided is a process for preparing a stable blend of plastic, preferably waste plastic, and petroleum for storage, transportation or feeding to a refinery unit with the blend comprising minimal, if any, chloride. By minimal, if any, chloride is meant that the amount of chloride present in the blend is less than 100 ppm chloride, or even less than 10 ppm chloride, and less than 5 ppm chloride. Minimal amounts of metals and other plastic contaminants are also desired and achieved. The process comprises first selecting plastics, preferably waste plastics, containing polyethylene and/or polypropylene. These waste plastics are then passed through a blend preparation unit to make a stable blend of waste plastic and petroleum comprising minimal, if any, chloride, metals and other plastic contaminants. The stable blend can then be safely fed to a refinery conversion unit for direct conversion of waste plastic to value-added chemicals and fuels.

The stable blend is made by a three or four-step process. The first step produces a hot, homogeneous liquid blend of plastic melt and petroleum feedstock. The preferred range of the plastic composition in the blend is about 1-20 wt. %. The preferred conditions for the hot liquid blend preparation include heating of plastic above the melting point of the plastic while vigorously mixing with petroleum feedstock. The preferred process conditions include heating to a 250-450° F. (121° to 232° C.) temperature, a residence time of 5-240 minutes at the final heating temperature, and 0-200 psig atmospheric pressure. This can be done in the open atmosphere as well as preferably under an oxygen-free inert atmosphere.

The second step involves hot filtering the blend mixture to remove any contaminants. The contaminants can include glass, metal, paper, PVC or other plastics with a low solubility such as PS, PETE and other Group 7 plastics, and inorganic filler materials used in plastic manufacturing. This filter step allows most of the PVC, PS, PETE and other plastics to be removed.

The third step comprises heating the filtered blend of feedstock and plastic to a temperature sufficient to decompose residual PVC. The temperature can be about 500° F. to 800° F. (260° to 427° C.), is generally found acceptable. The duration of the heating is sufficient to achieve decomposition of most if not all of the remaining PVC without decomposing any of the other plastic. A stripping gas such as nitrogen, hydrogen, steam, or offgas from a conversion unit may be added to facilitate purging of HCl offgas from the decomposition of PVC or organic chlorides in the blend. Hydrogen is a preferred stripping gas as it facilitates HCl formation and minimizes diene formation. The preferred conditions include heating to a temperature of 550°) to 700° F. (288° to 371° C.), a residence time of 5-240 minutes at the final heating temperature, and 0-200 psig pressure with 100-1500 scf/bbl of stripping gas. By keeping the temperature at about 550° to 700° F., only polyvinyl chloride decomposes to HCl and hydrocarbons. At this temperature range, polyethylene and polypropylene stay in the melted state but not decomposed. By minimizing the decomposition of polyethylene and polypropylene, the amounts of olefins and dienes in the blend are limited, and this will minimize the formation of organic chlorides which can be made by reactions of olefins and HCl.

FIG. 1 shows the thermal stability of polyethylene (PE), polypropylene (PP) and polyvinyl chloride (PVC) plastics determined by thermal gravimetric analysis (TGA). PVC decomposes at the 450°-700° F. (232° to 371° C.) temperature range via dehydrochlorination to form polyene and HCl gas. At a temperature above 700° F. (371° C.), the polyene further decomposes to low-molecular weight compounds. Any offgas from the heating, which would contain hydrogen chloride, is treated with a scrubber.

Polyethylene is stable up to 800° F. and polypropylene is stable up to 700° F. Vacuum gas oil (VGO) is stable at all temperature ranges from ambient to 1200° F. (649° C.). The weight change of VGO shown in FIG. 1 is due to the light components boiling off from VGO as a light hydrocarbon. To minimize the light hydrocarbon loss from the VGO, it is preferred to operate this chloride stripping process at an elevated pressure, for example above 10 psig, preferentially above 50 psig. Alternatively, an overhead condenser may be installed to condense the light hydrocarbon vapor back to liquid.

The last, or fourth step comprises an optional treating of the liquid product recovered from the third step with a chloride removal guard bed catalyst. Such catalyst beds are known in the industry to be effective in reducing chlorides to low ppm levels. In one embodiment, the catalyst beds are based on oxides, such as CaO or MgO or based on hydroxides, such as $Fe(OH)_2$. Such catalyst guard beds are available, for example, from Dorf Ketal, BASF, Evonik, Johnson Matthey, Clariant and Axens. The preferred conditions include treating at a temperature of 250° to 700° F. (121° to 371° C.), a residence time of 5-240 minutes, and 0-200 psig pressure. The resulting blend can then be safely fed to a refinery directly or cooled and stored for subsequent use. The subsequent use can comprise being fed to a refinery or transported and fed to a refinery.

In an alternative embodiment, the third and fourth dechlorination steps above can be combined into a single third step of treatment with a chloride removal guard bed catalyst. Such catalyst beds are known in the industry to be effective in reducing chlorides to low ppm levels. In one embodiment, the catalyst beds are based on oxides, such as CaO or MgO or based on hydroxides, such as $Fe(OH)_2$. Such catalyst guard beds are available, for example, from Dorf Ketal, BASF, Evonik, Johnson Matthey, Clariant and Axens. The preferred conditions include treating at a 250° to 700° F. temperature, a residence time of 5-240) minutes, and 0-200 psig pressure. Since this is a combination of the third and fourth steps, the temperature used will be selected to be appropriate for decomposition of PVC, so the temperature may be closer to 700° F. than is usual. However, the catalyst will aid in the decomposition process, so the selection of the appropriate temperature may not need to be as high compared to the necessary temperature in the absence of the catalyst. The resulting blend can then be safely fed to a refinery directly or cooled and stored for subsequent use. The subsequent use can comprise being fed to a refinery or transported and fed to a refinery.

For storage, the hot blend is cooled down below the melting point of the plastic while continuously, vigorously mixing, and then further cooling down to a lower temperature, preferably an ambient temperature, to produce a stable blend. The stable blend is either an oily liquid or in a waxy solid state at ambient temperature depending on the petroleum feedstock and plastic content and type. Since the blend is stable, it can be stored for lengthy time periods.

In one embodiment, the stable blend is made of a petroleum feedstock and 1-20 wt. % of waste plastic, wherein the plastic is in the form of finely dispersed micron-size particles with 10 micron to less than 100-microns average particle size. In one embodiment, the feedstock material in the blend can comprise a bio-feed material.

There are several advantages realized by the present blend and its use. For example, the stable blend of plastic and petroleum feedstock can be stored at ambient temperature and pressure for extended time periods. During the storage, no agglomeration, no settling of polymer particles and no chemical/physical degradation of the blend are observed. This allows easier handling of the waste plastic material for storage or transportation.

The stable blend can be handled easily by using standard pumps as are typically used in refineries or warehouses, or by using pumps equipped with transportation tanks. Depending on the blend, some heating of the blend above its pour point is required to pump the blend for transfer or for feeding to a conversion unit in a refinery. During the heating, no agglomeration of polymer is observed.

Another major advantage of the present blend, and the process of preparing the blend, is the removal of chloride to levels of less than 100 ppm, or even 10 ppm and less. Since refinery units have low chloride tolerance, the present blends can safely be provided to a refinery.

Another major advantage of the present blend, and the process of preparing the blend, is that it can be applied to multi-layer film plastic that is considered non-recyclable via current recycling processes. These multi-layer films comprise polyethylene and/or polypropylene layers, but also a thin metallic layer as a metallic barrier layer. This metallic layer often comprises aluminum as the metal. The polyethylene and polypropylene components in the multi-layer film can be dissolved selectively in a petroleum feedstock, and the metals that formed the metal layer of the multi-layer film can be removed via the filtration.

For feeding to a refinery unit, the stable blend is further heated above the melting point of the plastic to produce a homogeneous liquid blend of petroleum and plastic. The hot homogeneous liquid blend is fed directly to the oil refinery process units for conversion of waste plastics to high value products with good yields.

Refinery conversion units such as a fluid catalytic cracking (FCC) unit, hydrocracking unit, and hydrotreating unit, convert the hot homogeneous liquid blend of the plastic and petroleum feedstock in the presence of catalysts with simultaneous conversion of the plastic and petroleum feedstock. The presence of catalysts in the conversion unit allows conversion of the waste plastics to higher value products at a lower operating temperature than the typical pyrolysis temperature. The yields of undesirable byproducts (offgas, tars, coke, char) are lower than the typical pyrolysis process. For the hydroprocessing units (hydrocracking and hydrotreating units), hydrogen is added to units to improve the conversion of the plastics. The blend may generate additional synergistic benefits coming from the interaction of the plastic and petroleum feedstock during the conversion process. Fluid catalytic cracking and hydrocracking processes are preferred modes of catalytic conversion of the stable blend.

In one embodiment, the stable blend of plastic and petroleum feedstock can be sent to a coker unit for thermal conversion of waste plastics. In this case, there are no substantial advantages in the reactor temperature or the product yield compared to a pyrolysis process. The advantage of the coker unit is its feed flexibility in that the unit can handle a blend with very high nitrogen, sulfur, and metals impurities.

The stable blend of plastic and petroleum feedstock allows more efficient recycling of waste plastics. The use of the present blend is far more energy efficient than the current pyrolysis process, and allows recycling with a lower carbon footprint. The improved processes would allow establishment of a circular economy on a much larger scale by efficiently converting waste plastics back to virgin quality polymers or value-added chemicals and fuels.

Figure 2:
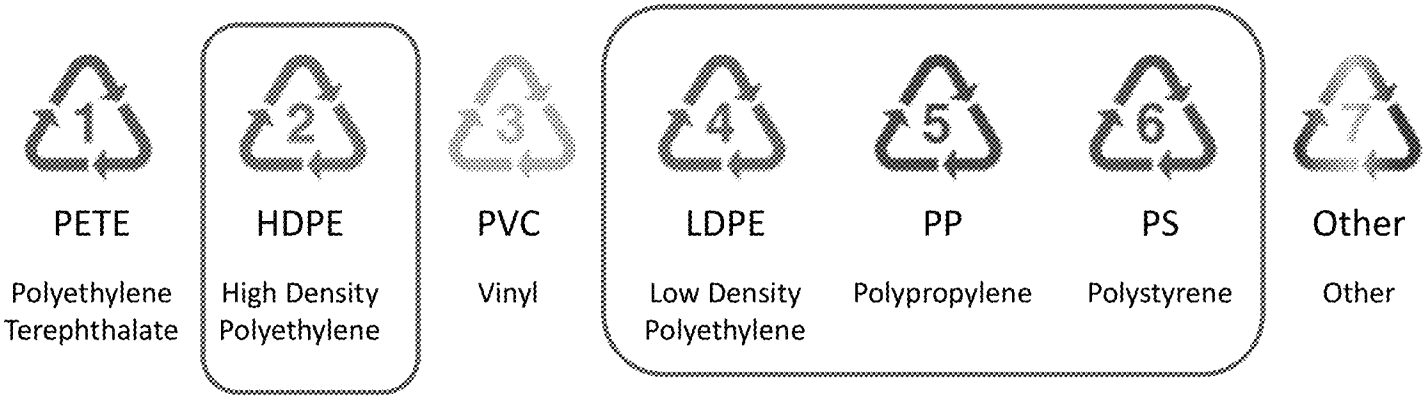
FIG. 2 depicts the plastic type classification for waste plastics recycling.

Proper sorting of waste plastics is very important in order to minimize contaminants such as N, Cl, and S. Plastics waste containing polyethylene terephthalate (plastics recycle classification type 1), polyvinyl chloride (plastics recycle classification type 3) and other polymers (plastics recycle classification type 7) need to be sorted out to less than 5%, preferably less than 1% and most preferably less than 0.1%. The present process can tolerate a moderate amount of polystyrene (plastics recycle classification type 6). Waste polystyrene needs to be sorted out to less than 20%, preferably less than 10% and most preferably less than 5%. FIG. 2 depicts the plastic type classification for waste plastics recycling.

Washing of waste plastics can remove metal contaminants such as sodium, calcium, magnesium, aluminum, and non-metal contaminants coming from other waste sources. Non-metal contaminants include contaminants coming from the Periodic Table Group IV, such as silica, contaminants from Group V, such as phosphorus and nitrogen compounds, contaminants from Group VI, such as sulfur compounds, and halide contaminants from Group VII, such as fluoride, chloride, and iodide. The residual metals, non-metal contaminants, and halides need to be removed to less than 50 ppm, preferentially less than 30 ppm and most preferentially to less than 5 ppm.

The petroleum with which the waste plastic is blended is generally a petroleum feedstock for the refinery. It is preferred that the petroleum blending oil is the same as the petroleum feedstock for the refinery. The petroleum can also comprise any petroleum derived oil or petroleum based material. In one embodiment, the petroleum feedstock oil can comprise atmospheric gas oil, vacuum gas oil (VGO), atmospheric residue, or heavy stocks recovered from other refinery operations. In one embodiment, the petroleum feedstock oil with which the waste plastic is blended comprises VGO. In one embodiment, the petroleum feedstock oil with which the waste plastic is blended comprises light cycle oil (LCO), heavy cycle oil (HCO), FCC naphtha, gasoline, diesel, toluene, and/or an aromatic solvent derived from petroleum.

In one embodiment, the petroleum feedstocks for the blend preparation include vacuum gas oil, atmospheric gas oil, reformate, light cycle oil, heavy fuel oil, refinery hydrocarbon streams containing toluene, xylene, heptane or benzene, or pure toluene, pure xylene, coker naphtha, $C_5$-$C_6$ isomerized paraffinic naphtha, FCC naphtha, hydrocracker bottom, gasoline, jet fuel, diesel or mixtures of some these.

The most preferred petroleum feedstocks are gas oil, heavy reformate, or various recycle streams that will be fed to a catalytic conversion unit. Then, the plastic and petroleum feedstock in the blend are converted together to a higher value product via catalytic conversion.

More than one petroleum feedstock can be used to optimize the blend properties. For example, the viscosity and pour point can be lowered by adding lighter petroleum feedstocks such as light cycle oil, gasoline, or diesel.

Optionally, solvents such as benzene, toluene, xylene or heptane may be added to the blend to reduce the viscosity or pour point of the blend of plastic and petroleum feedstock for easier handling.

In one embodiment, the feedstock with which the blend is prepared can comprise a bio-feed. The bio-fed can comprise the entire feedstock, or can be mixed with the petroleum feedstock.

In one embodiment, the petroleum feedstock is chosen for preferred dissolution of polyethylene and polypropylene. The petroleum feedstock exhibits high solubility of polyethylene and polypropylene plastics and exhibits low solubility of undesirable plastics, such as polyvinyl chloride, polystyrene, and other Group 7 plastics, as well as metal barrier films and inorganic impurities. These undesirable materials from waste plastic sources are removed by a filtration step. Examples of suitable petroleum feedstocks include vacuum gas oil (VGO), light cycle gas oil (LCO) and diesel.

The term "bio" refers to biochemical and/or natural chemicals found in nature. Thus, a bio feedstock or bio oil would comprise such natural chemicals. The preferred starting bio feedstocks for the blend preparation include triglycerides and fatty acids, plant-derived oils such as palm oil, canola oil, corn oil, and soybean oil, as well as animal-derived fats and oils such as tallow; lard, schmaltz (e.g., chicken fat), and fish oil, and mixtures of these.

The present process with its three or four steps to prepare the present blend ensures that the amount of chloride remaining in the blend is so small that no damage will be inflicted on the refinery units and equipment. The presence of chloride can create HCl acid which will cause deterioration of the units. This is of major importance since the refinery also has a purpose of preparing chemicals, base oils and fuel oils, and the units and equipment in the refinery are chloride sensitive, as noted. Furthermore, the chloride can also impact the catalyst used in a refinery and the product quality. By using the present blend, prepared by the present process, one can efficiently, effectively, and safely recycle waste plastic while also complementing the operation of a refinery in the preparation of higher value products such as gasoline, jet fuel, base oi, diesel fuel, and useful chemicals.

While not wanting to be bound by a theory, the present process prepares a stable blend of minimal, if any, chloride, metals and other plastic contaminants, that is an intimate physical mixture of plastic and petroleum feedstock for catalytic conversion in refinery units. The present process produces a stable blend of petroleum feedstock and plastic wherein the plastic is in a "de-agglomerated" state. The plastic maintains its state as "finely dispersed" solid particles in the petroleum feedstock at ambient temperature. This blend is stable and allows easy storage and transportation. At a refinery, the stable blend can be preheated above the melting point of the plastic to produce a hot, homogeneous liquid blend of plastic and petroleum, and then the hot liquid blend is fed to a conversion unit. Then both the petroleum feed and plastic are simultaneously converted in the conversion unit with typical refinery catalysts containing zeolite(s) and other active components such as silica-alumina, alumina and clay.

Use of the present blend avoids the pyrolysis of waste plastic. Rather, a stable blend of petroleum feedstock and the waste plastic as prepared can be fed to the refinery units. Thus, the pyrolysis step can be avoided, which is a significant energy savings.

In cooling and storing the blend, the hot homogeneous liquid blend is cooled to ambient temperature in a controlled manner to allow for easy storage and transportation. By using this method, a stable blend can be prepared at a facility away from a refinery and can be transported to a refinery unit. Then, the stable blend is heated above the melting point of the plastic to feed to the refinery conversion unit. The stable blend is a physical mixture of micron-size plastic particles finely suspended in the petroleum-based oil, with the average particle size of the plastic particles of 10 micron to less than 100 microns. The mixture is stable, and the plastic particles do not settle or agglomerate upon storage for an extended period.

What is meant by heating the blend to a temperature above the melting point of the plastic is clear when a single plastic is used. However, if the waste plastic comprises more than one waste plastic, then the melting point of the plastic with the highest melting point is exceeded. Thus, the melting points of all plastics must be exceeded. Similarly, if the blend is cooled below the melting point of the plastic, the temperature must be cooled below the melting points of all plastics comprising the blend.

Compared with a pyrolysis unit, these blend preparation units operate at a much lower temperature (~500-600° C. vs. 120-250° C.). Thus, employing the present blend in conjunction with a refinery can provide a far more energy efficient process than a thermal cracking process such as pyrolysis.

The use of the present waste plastic/petroleum blend further increases the overall hydrocarbon yield obtained from the waste plastic. This increase in yield is significant. The hydrocarbon yield using the present blend offers a hydrocarbon yield that can be as much as 98%. To the contrary, pyrolysis produces a significant amount of light product from the plastic waste, about 10-30 wt. %, and about 5-10 wt. % of char. These light hydrocarbons are used as fuel to operate the pyrolysis plant, as mentioned above. Thus, the liquid hydrocarbon yield from the pyrolysis plant is at most 70-80%.

When the present blend is passed into the refinery units, such as an FCC unit, only a minor amount of offgas is produced. Refinery units use catalytic cracking processes that are different from the thermal cracking process used in pyrolysis. With catalytic processes, the production of undesirable light-end byproducts such as methane and ethane is minimized. Refinery units have efficient product fractionation and are able to utilize all hydrocarbon products streams efficiently to produce high value materials. Refinery co-feeding will produce only about 2% of offgas ($H_2$, methane, ethane, ethylene). The $C_3$ and $C_4$ streams can be captured to produce useful products such as circular polymer and/or quality fuel products. Thus, the use of the present petroleum/plastic blend offers increased hydrocarbons from the plastic waste, as well as a more energy efficient recycling process compared to a thermal process such as pyrolysis. The benefits of the present blend are significant when considering recycling waste plastic.

Figure 3:
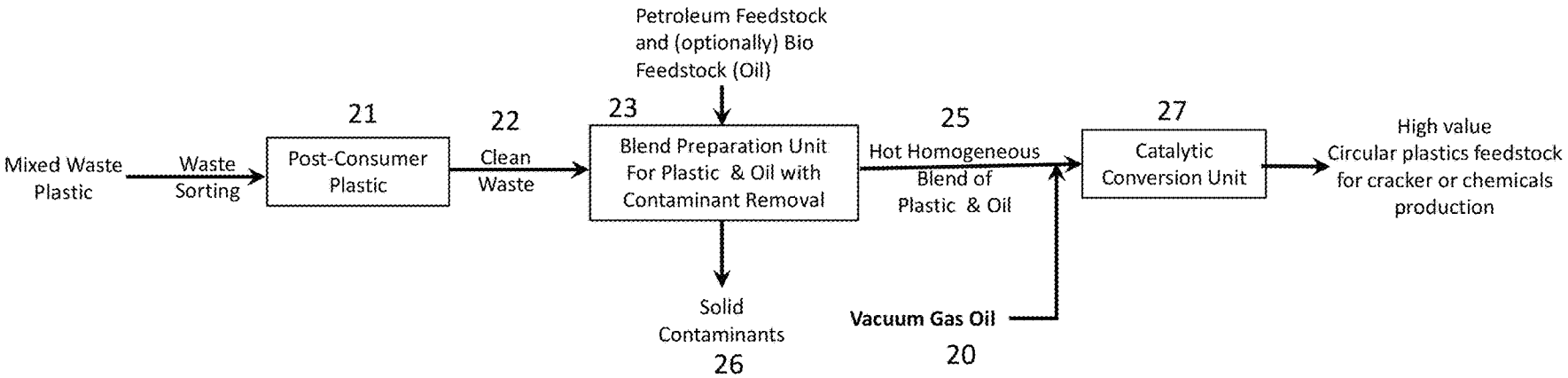
FIG. 3 depicts a present process of preparing a hot homogeneous liquid blend of plastic and petroleum feedstock and how the blend can be fed to a refinery conversion unit.

FIG. 3 illustrates a method for preparing a hot homogenous blend of plastic and petroleum feedstock which can be used for direct injection to a refinery unit. The preferred range of the plastic composition in the blend is about 1-20 wt. %. If high molecular weight polypropylene (average molecular weight of 250,000 or greater) waste plastic or high-density polyethylene (density above 0.93 g/cc) is used as the predominant waste plastic, e.g., at least 50 wt. %, then the amount of waste plastic used in the blend is more preferably about 10 wt. % or less. The reason being that the pour point and viscosity of the blend would be high. In one embodiment, the plastic can comprise polypropylene having an average molecular weight, $M_w$, in the range of 5,000 to 150,000. In another embodiment, the plastic can comprise polypropylene having an average molecular weight, $M_w$, in the range of 150,000 to 400,000.

The preferred conditions for the hot homogeneous liquid blend preparation include heating the plastic above the melting point of the plastic while vigorously mixing with a petroleum feedstock. The preferred process conditions include heating to a 250-450° F. temperature, with a residence time of 5-240) minutes at the final heating temperature, and 0-200 psig atmospheric pressure. This can be done in an open atmosphere as well as under an oxygen-free inert atmosphere.

The hot homogeneous blend of plastic melt and petroleum feedstock is prepared by mixing a petroleum feed and a plastic together and then heating the mixture above the melting point of the plastic, but not greater than 500° F., while thoroughly mixing. Alternatively, it is prepared by melting the plastic only and then adding the plastic melt to the warm or hot petroleum feedstock while thoroughly mixing. Alternatively, it is prepared by heating the petroleum only to the temperature above the melting point of the plastic and then adding solid plastic slowly to the hot petroleum liquid while thoroughly mixing the mixture and maintaining the temperature above the melting point of the plastic.

Referring to FIG. 3 of the Drawings, a stepwise preparation process of preparing the hot homogeneous liquid blend is shown. Mixed waste plastic is sorted to create post-consumer waste plastic 21 comprising polyethylene and/or polypropylene. The waste plastic is cleaned 22 and then mixed with an oil 24 in a hot blend preparation unit 23. After the mixing in 23, the homogeneous blend of the plastic and oil is recovered 25. Optionally a filtration device may be added (not shown) to the hot blend preparation unit 23 to remove any undissolved solid contaminant 26, such as undissolved plastic particles (PTFE, PVC, PS, Group 7 other Plastic) or any solid impurities such as glass, metal, paper present in the hot liquid blend. The hot blend of the plastic and oil 25 can then be combined with a refinery feedstock, such as vacuum gas oil 20 (VGO), and become a mixture of the plastic/oil blend and VGO, which can then be passed to a catalytic conversion unit 27 in a refinery.

Figure 4:
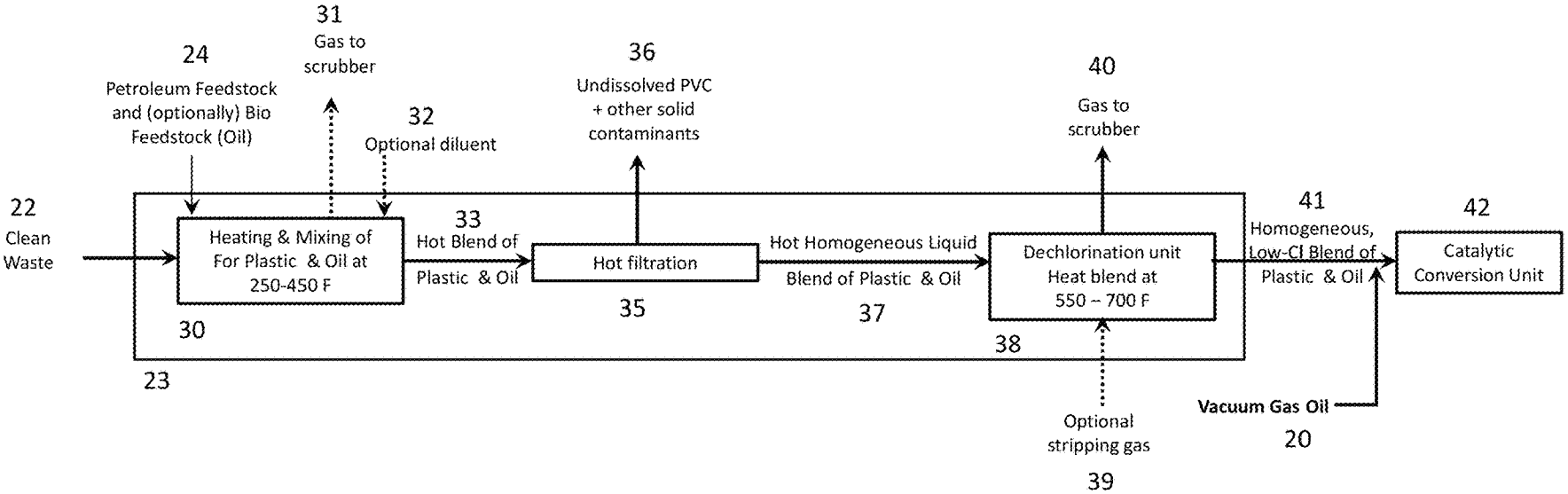
FIG. 4 depicts in detail the homogeneous blend preparation with minimal chloride and other plastic contaminants and how the homogeneous blend can be fed to a refinery conversion unit.

FIG. 4 illustrates a detailed method for preparing a low-chloride, low impurity homogeneous blend of plastic and oil using the present four-step process. The homogeneous blend is made in a homogeneous blend preparation unit 23 by a four-step process. The first step produces a hot, homogeneous liquid blend of plastic melt and petroleum feedstock, the step is identical to the hot blend preparation described in FIG. 3. As shown, clean waste 22 is passed to the homogeneous blend preparation unit 23. The selected plastic waste 22 mixed with a hot refinery feedstock oil 24 at the plastic dissolution vessel 30 where the plastic waste is heated above the melting point of the plastic to melt the plastic. The hot petroleum feedstock 24 is mixed with the melted plastic to produce a homogeneous liquid blend of dissolved plastic and VGO while maintaining the vessel temperature above the melting point of the PE and PP plastic at 30. The mixing is often quite vigorous. The preferred range of the plastic composition in the blend is about 1-20 wt. %. If high molecular weight polypropylene (average molecular weight of 250,000 or greater) waste plastic or high-density polyethylene (density above 0.93 g/cc) is used as the predominant waste plastic, e.g., at least 50 wt. %, then the amount of waste plastic used in the blend is more preferably about 10 wt. % or less. The reason being that the pour point and viscosity of the blend would be high.

The preferred conditions for the hot homogeneous liquid blend preparation at 30 include heating the plastic above the melting point of the plastic while vigorously mixing with a petroleum feedstock. The preferred process conditions include heating to a 250°-450° F. temperature, with a residence time of 5-240 minutes at the final heating temperature, and 0-200 psig atmospheric pressure. This can be done in an open atmosphere as well as under an oxygen-free inert atmosphere.

Any off-gas from the mixing, if any, can be sent 31 to a scrubber. If desired, optional diluent 32 can be added to the heating and mixing at 30.

The hot blend mixture 33 of plastic and oil is then recovered and sent to a hot filtration unit 35. Contaminants are removed 36, which contaminants can include glass, metal, PVC or other plastics of low solubility. This filter step allows most of the PVC to be removed.

The filtered hot liquid blend of plastics and oil 37 is then sent to a dechlorination unit 38. In the dechlorination unit, the blend is heated to a temperature of about 500° to 800° F. preferably 550° to 700° F. The duration of the heating is sufficient to achieve decomposition of most if not all of the remaining PVC. An optional stripping gas 39 may be added to facilitate purging of HCl offgas from the decomposition of PVC or organic chlorides in the blend. Potential sources of stripping gas include nitrogen, hydrogen, steam, or offgas from conversion unit 42. Hydrogen is a preferred stripping gas as it facilitates HCl formation and minimizes diene formation. The preferred conditions include heating to a temperature of 550° to 700° F., a residence time of 5-240) minutes at the final heating temperature, and 0-200 psig pressure with 100-1500 scf/bbl of stripping gas. Any offgas from the heating, which would contain hydrogen chloride, is sent 40) for treatment with a scrubber.

The dechlorination unit can also involve a fourth step (not shown), which involves treating the heated liquid blend product with a chloride removal guard bed. Such guard beds generally contain a metal oxide or hydroxide adsorbent and are known in the industry to be effective in reducing chlorides. The preferred conditions include treating at a temperature of 250° to 700° F., a residence time of 5-240) minutes, and 0-200 psig pressure.

The resulting hot, homogeneous, low-chloride blend 41 can then be fed directly to a refinery catalytic conversion unit 42. Alternatively, the hot blend of the plastic and oil 41 can be combined with a refinery feedstock, such as vacuum gas oil 20 (VGO), and become a mixture of the plastic/oil blend and VGO, which can then be passed to a catalytic conversion unit 42 in a refinery.

Optionally the homogeneous blend 41 can be cooled to ambient temperature to produce a stable blend. It has been found that the stable blend is an intimate physical mixture of plastic and petroleum feedstock. The plastic is in a "de-agglomerated" state. The plastic maintains a finely dispersed state of solid particles in the petroleum feedstock at temperatures below the melting point of the plastic, and particularly at ambient temperatures. The blend is stable and allows easy storage and transportation. At a refinery, the stable blend can be heated in a preheater above the melting point of the plastic to produce a hot, homogenous liquid blend of the plastic and petroleum. The hot liquid blend can then be fed to a refinery unit as a cofeed with conventional refinery feed.

The preferred plastic starting material for use in the present blend is sorted waste plastics containing predominantly polyethylene and polypropylene (plastics recycle classification types 2, 4, and 5). The pre-sorted waste plastics are washed and shredded or pelleted to feed to a blend preparation unit. FIG. 2 depicts the plastic type classification for waste plastics recycling. Classification types 2, 4, and 5 are high density polyethylene, low density polyethylene and polypropylene, respectively. Any combination of the polyethylene and polypropylene waste plastics can be used. Polystyrene, classification 6, can also be present in a limited amount.

EXAMPLES

Example 1: Properties of Virgin Plastic Samples

Six commercial plastic samples, low density polyethylene (LDPE, Plastic A), high density polyethylene (HDPE, Plastic B), two polypropylene samples with average molecular weight of ~12,000 (PP, Plastic C) and ~250,000 (PP, Plastic D), polystyrene (PS, Plastic E) and polyvinyl chloride (PVC, Plastic F) were purchased and their properties are summarized in Table 1.

TABLE 1

Properties of Plastics Used

| | LDPE (Plastic A) | HDPE (Plastic B) | PP (Plastic C) | PP (Plastic D) | PS (Plastic E) | PVC (Plastic F) |
|---|---|---|---|---|---|---|
| Form | Pellets | Pellets | Pellets | Pellets | Pellets | Powder |
| Melt Index | 25 g/ 10 min (190° C./ 2.16 kg) | 12 g/ 10 min (190° C./ 2.16 kg) | — | 12 g/ 10 min (230° C./ 2.16 kg) | 2.0-4.0 g/ 10 min | — |
| Melting Point, ° C. | 116 | 125-140 | 157 | 160-165 | 270 | 100-260* |
| Transition Temp, ° C. | 93, softening | 125, softening | 163, softening | — | 95 | 82 |
| Density, g/mL at 25° C. | 0.925 | 0.952 | 0.9 | 0.9 | 1.04 | 1.4 |

TABLE 1-continued

| Properties of Plastics Used | | | | | | |
|---|---|---|---|---|---|---|
| | LDPE (Plastic A) | HDPE (Plastic B) | PP (Plastic C) | PP (Plastic D) | PS (Plastic E) | PVC (Plastic F) |
| Hardness | — | 66 | — | 100 | — | — |
| Average molecular weight, $M_w$ | — | — | ~12,000 | ~250,000 | ~350,000 | ~48,000 |
| Average molecular weight, $M_n$ | — | — | ~5,000 | ~67,000 | ~170,000 | — |

*includes decomposition temperature for PVC.

FIG. 1 shows the thermal stability of polyethylene (PE), polypropylene (PP) and polyvinyl chloride (PVC) plastics determined by thermal gravimetric analysis (TGA). PVC decomposes at the 450°-700° F. temperature range via dehydrochlorination to form polyene and HCl gas. At the temperature above 700° F., the polyene further decomposes to low-molecular weight compounds. Polyethylene is stable up to 800° F. and polypropylene is stable up to 700° F. Vacuum gas oil (VGO) is stable at all temperature ranges from ambient to 1200° F. The weight change of VGO shown in FIG. 1 is due to the light components boiling off from VGO as light hydrocarbon.

Example 2: Properties of Recycled Waste Plastic Samples

Four recycled waste plastic samples were purchased for blend preparations and their properties are summarized in Table 2.

FT-IR was used to identify the general nature of the plastic. In addition to identification of the predominant polymer species, the FT-IR data also revealed that all these recycled plastic contained varying amounts of calcium carbonates and talc. To estimate the amount of potentially recoverable hydrocarbon, each sample was calcined under $N_2$ at 1000° F. for 3 hours. It was assumed that the recoverable hydrocarbon equals to the % loss-on-ignition (LOI). The inorganic residue from the calcination was analyzed with ICP elemental analysis. Using the LOI value and ICP analysis, the impurities of each household plastic sample were estimated and reported in Table 2 below. The most common impurities in waste plastic are Ca, Mg, Si, Ti and Al that may come from plastic consumer product manufacturing as calcium carbonate, silica, talc are commonly used filler material. Fe, Na, P and Zn are also present in varying quantities.

TABLE 2

| Properties of Recycled Waste Plastics | | | | |
|---|---|---|---|---|
| | Waste Plastic #1 (Plastic G) | Waste Plastic #2 (Plastic H) | Waste Plastic #3 (Plastic I) | Waste Plastic #4 (Plastic J) |
| Form | Pellets | Pellets | Pellets | Pellets |
| General Identification | PP, PE Mix | Polypropylene | PE, PP mix | PP, PE mix |
| LOI, wt % | 93.4 | 99.4 | 96.9 | 98.1 |
| Impurities, wt % of the as-received sample | | | | |
| Al, wt % | 0.15 | — | 0.03 | 0.05 |
| Ca, wt % | 1.41 | — | 0.51 | 0.49 |
| Fe, wt % | 0.06 | — | 0.01 | 0.11 |
| K, wt % | 0.01 | — | 0 | 0 |
| Mg, wt % | 0.34 | — | 0.02 | 0.04 |
| Na, wt % | 0.03 | — | 0.01 | 0.01 |
| P, wt % | 0.01 | — | 0 | 0 |
| Si, wt % | 0.82 | — | 0.06 | 0.12 |
| Ti, wt % | 0.24 | — | 1.01 | 0.52 |
| Zn, wt % | 0.01 | — | 0.01 | 0.01 |
| Sum, wt % | 3.09 | — | 1.65 | 1.34 |
| Inorganic Residue at 950° F., wt % by TGA | 8.2 | 1.1 | 3.7 | 1.4 |

Figure 5:
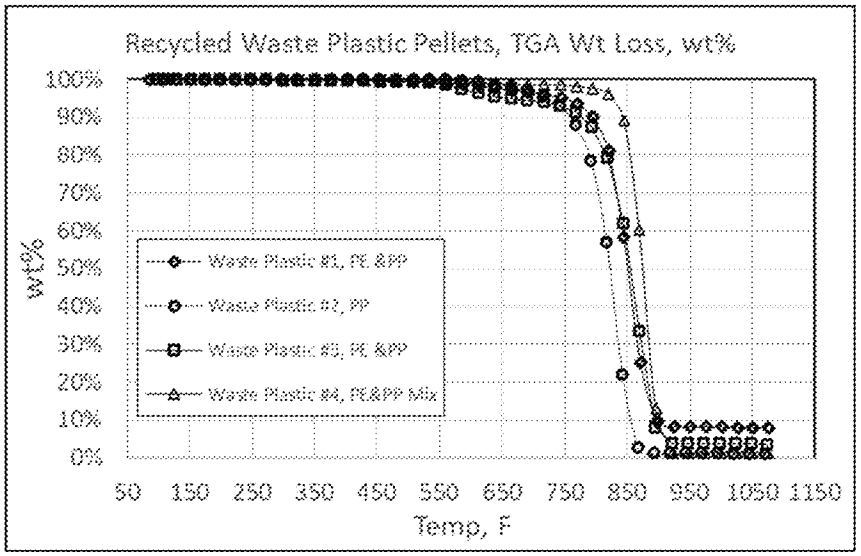
FIG. 5 graphically shows Thermal Gravimetric Analysis (TGA) results for recycled waste plastics containing PE and PP.

Thermal Gravimetric Analysis (TGA) was conducted with the waste plastic samples to verify the plastic materials are thermally stable well above the melt preparation temperature. TGA results shown in FIG. 5 indicate the waste plastic samples are stable up to 700° F. From the TGA results, the weight percents of the residue weight at 950° F. (510° C.) are reported in Table 2. The residual weights from the TGA analysis corroborate well with the LOI measured by calcination.

Example 3: Properties of Household Waste Plastic Samples

Five household plastic (HHP) samples were collected for blend preparations and their properties are summarized in Table 3. HHP #1 was a collection of semi-rigid plastic poly bubble shipping envelops. HHP #2 was a collection of light-weight poly shipping bags made with 50% recycled content. HHP #3 was a collection of take-out food packages which were labelled as recyclable plastic Group 6 (polystyrene, PS). HHP #4 was clear fruit and veggie packages which were labelled as recyclable plastic Group 1 (polyethylene terephthalate, PETE). HHP #5 was potato chip packages and labelled as not recyclable.

Using the LOI value and ICP elemental analysis, as described in Example 2, the impurities in household plastic samples are estimated and reported in Table 3 below. The most common impurities in waste plastic are Ti, Ca, Si and Al that may come from plastic consumer product manufacturing as talc, calcium carbonate, and silica as commonly used filler materials. The high Ti impurity content of the HH Plastic #2 is likely coming from the addition of titanium dioxide during the recycling process.

TABLE 3

Properties of Household Plastics

| | HH Plastic #1 (Plastic K) | HH Plastic #2 (Plastic L) | HH Plastic #3 (Plastic M) | HH Plastic #4 (Plastic N) | HH Plastic #5 (Plastic O) |
|---|---|---|---|---|---|
| Form | Poly bubble shipping envelop | Light-weight poly shipping bags | Food takeout container | Clear fruit/ veggie containers | Multilayer potato chip bags |
| General Identification for recycling | Bring to collection | Bring to collection | Recyclable, PS, Group 6 | Recyclable, PETE, Group 1 | Do not recycle |
| LOI, wt % | 96.4 | 89.3 | — | — | 96.6 |
| Impurities, wt % of the as-received sample | | | | | |
| Al, wt % | 0.10 | 0.41 | — | — | 0.22 |
| Ca, wt % | 0.05 | 0.63 | — | — | 0.44 |
| Fe, wt % | 0.01 | 0.01 | — | — | 0.01 |
| K, wt % | 0.01 | 0.02 | — | — | 0 |
| Mg, wt % | 0.01 | 0.02 | — | — | 0 |
| Na, wt % | 0.03 | 0.06 | — | — | 0.01 |
| P, wt % | 0 | 0.01 | — | — | 0 |
| Si, wt % | 0.28 | 0.29 | — | — | 0.04 |
| Ti, wt % | 1.40 | 4.44 | — | — | 1.03 |
| Zn, wt % | 0 | 0.02 | — | — | 0 |
| Sum, wt % | 1.98 | 5.89 | — | — | 1.77 |
| Inorganic Residue at 950° F., wt % by TGA | 3.4 | 14.7 | 0.1 | 15.6 | 2.0 |

Figure 6:
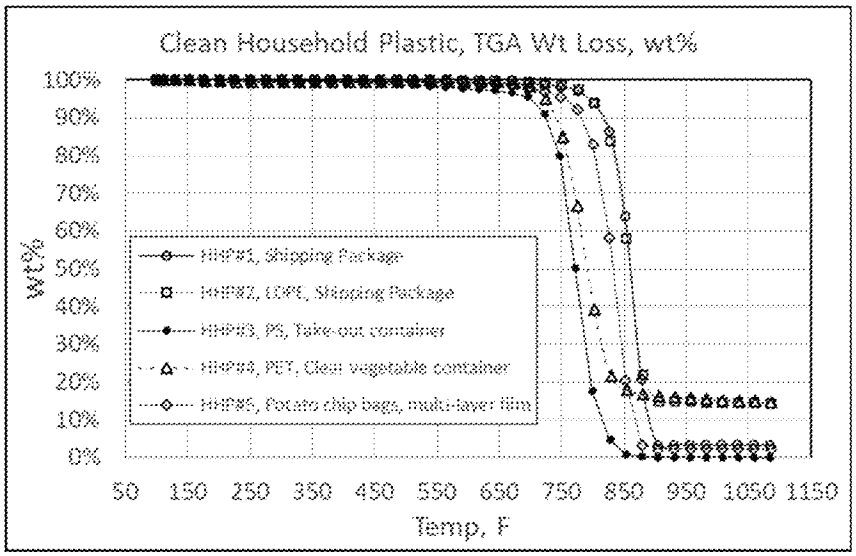
FIG. 6 graphically shows Thermal Gravimetric Analysis (TGA) results for household plastics.

Thermal Gravimetric Analysis (TGA) was conducted with the waste plastic samples to verify the plastic materials are thermally stable well above the melt preparation temperature. TGA results shown in FIG. 6 indicate the waste plastic samples are stable up to 700° F. From the TGA results, the weight percents of the residue weight at 950° F. are reported in Table 3. The residual weights from the TGA analysis corroborate well with the LOI measured by calcination for HH Plastic #1, #2, and #5. TGA analysis of HH Plastic #3 (PS) shows the material is very pure containing very little inorganic filler material. TGA analysis of HH Plastic #4 (PETE) shows 15.6% of residue which could be either inorganic filler material or carbonaceous residue.

Example 4: Properties of Petroleum Feedstock for Blend Preparations

Petroleum feedstocks that can be used to prepare the stable blends with plastic includes hydrotreated vacuum gas oil (VGO), Aromatic 100 solvent, light cycle oil (LCO), and diesel. Their properties are shown in Table 4. Aromatic 100 is a commercially available aromatic solvent manufactured from petroleum-based material, 0mainly contains $C_9$-$C_{10}$ dialkyl and trialkyl benzenes.

TABLE 4

Properties of Petroleum Feedstocks for Blend Preparation

| | Hydrotreated VGO Petroleum Feed #1 | Aromatic 100 Petroleum Feed #2 | LCO Petro-leum Feed #3 | Diesel Petro-leum Feed #4 |
|---|---|---|---|---|
| Specific Gravity | 0.897 | 0.872 | 0.956 | 0.811 |
| Carbon, wt % | 87.84 | 89.90 | 90.50 | 86.4 |
| Hydrogen, wt % | 12.69 | 10.10 | 9.50 | 14.6 |

TABLE 4-continued

Properties of Petroleum Feedstocks for Blend Preparation

| | Hydrotreated VGO Petroleum Feed #1 | Aromatic 100 Petroleum Feed #2 | LCO Petro-leum Feed #3 | Diesel Petro-leum Feed #4 |
|---|---|---|---|---|
| H/C Molar Ratio | 1.73 | 1.33 | 1.26 | 2.0 |
| Bromine Number | 2 | — | — | 0.1 |
| Total S, ppm | 150 | 0 | 900 | <2 |
| Total N, ppm | 273 | 0 | N/A | <0.1 |
| Ni, ppm | <0.6 | 0 | <0.2 | <0.2 |
| V, ppm | <0.6 | 0 | <0.2 | <0.2 |
| Simdist, ° F. | | | | |
| IBP (0.5%) | 462 | 297 | 235 | 536 |
| 5 wt % | 573 | 325 | 405 | 553 |
| 10 wt % | 616 | 327 | 441 | 563 |
| 30 wt % | 706 | 330 | 490 | 601 |
| 50 wt % | 775 | 336 | 541 | 638 |
| 70 wt % | 854 | 344 | 607 | 673 |
| 90 wt % | 962 | 355 | 689 | 702 |
| 95 wt % | 1008 | 362 | 718 | 709 |
| FBP (99.5%) | 1107 | 376 | 786 | 717 |

Example 5: Blend Preparations of Recycled Waste Plastic and VGO, and Reduction of Impurity by Filtration Several blends, each made of vacuum gas oil (VGO) and a recycled waste plastic sample (Plastic G through J from Table 2), were prepared by adding the plastic pellets to a hydrotreated vacuum gas oil (Petroleum Feed #1 of Table 4) using an autoclave.

The following procedure was used. At ambient temperature, pre-weighed plastic pellets (solids) and the VGO feed (waxy solids) were added to a batch autoclave unit. The autoclave was purged with $N_2$ gas to remove air in the vessel, and then the inlet and outlet valves were closed. The mixture was stirred with an impeller at 1500 RPM while the mixture was heated with an external heating jacket to the target temperature of 204° C. (400° F.) by raising the temperature set point by 28° C. (50° F.) or every 10 minutes. Then, the temperature was held at the target temperature for 1 hour. The pressure was monitored for the entire time. Typically, the pressure was built up to less than 10 psig. For most of the blend preps, the hot blend was filtered in a 400° F. hot oven using cellulose filters with well-defined pore size (0.7 or 20 micron filter papers were used). A few cases, the blend was not filtered to examine the impact of filtration for impurity removal.

After the dissolution of 10 wt % plastic, we observed some solid precipitation likely coming from the filler material, and the blends were generally exhibited very high viscosity, likely due to presence of solids. For dissolution of 5 wt % plastic, the blends were filtered easily and gummy solid materials were filtered out. The filtered blend products were cooled to ambient temperature and the resulting stable blends showed no visible plastic residue and were completely homogeneous per visual observation. The blends of the plastic and VGO showed the look of VGO's waxy solids. The blend of plastic and VGO was stable, and no change was observed for a 3-month period of observation.

To assess material handling needs, a pour point (per ASTM D5950-14) and viscosity (per ASTM D445) of the blend were measured. In addition, a content of hot heptane insoluble material was measured per the ASTM D3279 procedure. The hot heptane insoluble method determines the weight percent of material in oils that is insoluble in hot heptane at 80° C. The method isolates the insoluble material using 0.8-micron membrane filter. The heptane insoluble content provides information on non-dissolved plastic in the blend. The chloride content of the blend was measured using combustion ion chromatography (per ASTM D7359). Table 5 below summarizes the list of samples prepared and their properties.

TABLE 5

Preparation for Stable Blend of Waste Plastic and VGO

| Example | Wt % of Recycled Waste Plastic (WP #) in blend | Filtration Pore size, | Pour Point,° C. | Viscosity at 180° C. | Heptane Insoluble, wt % | Chloride, ppm |
|---|---|---|---|---|---|---|
| Example 5-1 | VGO only (base case) | No | 40 | 1.7 | 0.01 | <1 |
| Example 5-2 | 10 wt % WP #1 | No | 97 | 344 | 9.6 | — |
| Example 5-3 | 5 wt % WP #1 | 20 | 111 | — | 4.7 | 48 |
| Example 5-4 | 10 wt % WP #2 | No | 91 | — | — | 9.2 |
| Example 5-5 | 5 wt % WP #2 | 20 | 33 | 13.4 | 5.6 | 1.3 |
| Example 5-6 | 10 wt % WP #3 | No | 102 | 223 | 9.3 | 29 |
| Example 5-7 | 5 wt % WP #3 | 0.7 | 96 | 32 | 4.2 | 12 |
| Example 5-8 | 10 wt % WP #4 | No | 108 | 1081 | 9.6 | 83 |
| Example 5-9 | 10 wt % WP #4 | 0.7 | — | — | — | 17 |
| Example 5-10 | 5 wt % WP #4 | 20 | 90 | 159 | 6.1 | 43 |
| Example 5-11 | 5 wt % WP #4 | 0.7 | 93 | 74 | 6.2 | 24 |

The heptane insoluble test in Table 5 above correlates with the amount of plastic in the blend. The heptane insoluble test indicates that the plastic is a physical mixture of solid particles dispersed in VGO in the blend at 80° C. and that the bulk of plastic particles can be separated effectively with the 0.8-micron filter. The slight difference between the heptane insoluble material content and the amount of plastic we added may be either due to very small particles (less than 0.8-micron) not captured by the filter during the heptane insoluble measurement or due to the residual filtered impurities from the waste plastic trapping some VGO in the filter cake and providing the slightly higher weight percent. For the blends made with Waste Plastics #1 and #3, the heptane insoluble content is slightly less than the amount of plastic added for the blend prep, suggesting some of the particles may have a smaller size than the 0.8-micron filter opening. For the blends made with Waste Plastics #2 and #4, the heptane insoluble content is slightly higher than the amount of plastic added for the blend prep. Perhaps residual impurities such as cellulose from paper may trap some VGO in the filter cake and thereby give the slightly higher weight percent.

Without filtration, the as-prepared blends with recycled plastic with high impurities (such as filler materials and paper fibers) show very high viscosity which would make the pumping to a conversion unit challenging (Examples 5-2, 5-6 and 5-8). Filtration with 0.7 or 20 micron filter was effective in removing the solid materials and lowering the viscosities significantly. Also the filtration lowered the chloride content of the blends.

This example clearly showed that filtration is a critical step to prepare the plastic/petroleum feedstock blend made from waste plastic. The present process is effective in preparing a stable blend of minimal chloride and other plastic contaminants, that is an intimate physical mixture of plastic and petroleum feedstock, for catalytic conversion in refinery units.

Example 6: Blend Preparations of Household Waste Plastic and VGO, and Reduction of Other Plastics by Filtration Several blends, each made of of vacuum gas oil (VGO, Petroleum Feed #1 of Table 4) and a household plastic sample (Plastic K through O from Table 3), were prepared using the procedure similar to the Example 5. The dissolution was conducted in a 1 L glass beaker with an overhead stirrer. The VGO was heated to 400° F. first, then finely cut plastic pieces were added to the beaker to make a blend of the plastic and VGO. In some cases, not all of the plastic was dissolved. The hot blend was filtered in a 400° F. hot oven using cellulose filter papers with 20-micron pore openings. Similar analyses were conducted and the results are summarized in Table 6.

TABLE 6

Preparation for Stable Blend of Household Plastic and VGO

| Example | Wt % of Household Plastic (HHP #) in blend | Filtration Pore size, μ | Pour Point, ° C. | Viscosity at 180° C., CSt | Heptane Insoluble, wt % |
|---|---|---|---|---|---|
| Example 5-1 | VGO only (base case) | No | 40 | 1.7 | 0.01 |
| Example 6-1 | 5 wt % HHP #1 (mix of PE and PP) | 20 | 99 | 57 | 5.3 |
| Example 6-2 | 5 wt % HHP #2 (LDPE) | 20 | 78 | 39 | 5.6 |
| Example 6-3 | 5 wt % HHP #3 (PS) | 20 | 35 | 2.2 | 0.7 |
| Example 6-4 | 5 wt % HHP #4 (PETE) | 20 | 36 | 1.5 | 0.1 |
| Example 6-5 | 5 wt % HHP #5 (multilayer film, "Do Not Recycle") | 20 | 102 | 20 | 4.8 |

The heptane insoluble test results in Table 6 above show roughly the amount of polyethylene and polypropylene dissolved in the blend. For Household Plastic #1 and #2, the heptane insoluble content is comparable to or slightly higher than the amount of plastic added to the blend prep. The slight difference in the heptane insoluble content to the amount of plastic we added (5.3-5.6 wt % vs. 5.0 wt %) may be due to an experimental error or residual impurities may trap some VGO in the filter cake during the heptane insoluble measurement and gave the slightly higher weight percent.

Household Plastic #3 made of polystyrene (PS, Group 6 plastic) has very low solubility in VGO as shown in the heptane insoluble test of 0.7 wt %. The viscosity and pour points of the blend (Example 6-3) are comparable to the VGO only base case (Example 5-1) since not much of the PS added was dissolved in the blend and most of PS was filtered out. Household Plastic #4 made of polyethylene terephthalate (PETE, Group 1 plastic) has even lower solubility in VGO as shown in the heptane insoluble test of 0.1 wt %. The viscosity and pour points of the blend (Example 6-4) are again comparable to the VGO only base case (Example 5-1) since almost none of the PETE was dissolved in the blend and all PETE was filtered out. These results clearly indicate with proper selection of petroleum feedstock, one can prevent the undesirable plastic materials from dissolving into the blend and then filter them out. These results clearly show that VGO is an excellent petroleum feedstock that selectively dissolving polyethylene (HDPE and LDPE, Group 2 and 4) and polypropylene (PP, Group 5).

Household Plastic #5 was a collection of potato chip bags. These bags are made of multi-layer film with thin aluminum metal barrier layers to prevent permeation of moisture and air to the content of the bags. Recycling of this type of plastic material was considered nearly impossible since there is no good way to separate the metal layers and the multi-plastic layers. These bags are marked as "Do Not Recycle." With our dissolution method, we were able to dissolve polyethylene (HDPE and LDPE, Group 2 and 4) and polypropylene (PP, Group 5) selectively from the Household Plastic #5 as shown in the heptane insoluble test of 4.8 wt %. It appears that a new, effective way to recycle the multi-layer films containing aluminum metal barrier layers has been discovered.

The impurity levels of the final blends were measured with an ICP test and reported in Table 7. The overall impurity levels are low enough that these blends can be fed to a refinery conversion unit for catalytic conversion processes.

TABLE 7

Composition of Stable Blends Prepared from Household Plastic and VGO

| Example | Example 6-1 | Example 6-2 | Example 6-3 | Example 6-4 | Example 6-5 |
|---|---|---|---|---|---|
| Cl, ppm | 1.4 | 6.4 | 2.5 | <1 | 7.0 |
| Al, ppm | <11 | 96 | <11 | <11 | <11 |
| Ca, ppm | <25 | 214 | <25 | <24 | <24 |
| Fe, ppm | <8 | <8 | <8 | <8 | <8 |
| Mg, ppm | <8 | <8 | <8 | <8 | <8 |
| Na, ppm | <4 | 10 | <4 | <4 | <4 |
| P, ppm | <5 | <5 | <5 | <5 | <5 |
| Si, ppm | 2220 | 50 | 21 | <12 | 30 |
| Ti, ppm | <25 | 411 | <13 | <12 | <12 |
| Zn, ppm | <8 | <8 | <8 | <8 | <8 |

The Table 7 results clearly show that a stable blend of minimal chloride, undesirable metals (Na, P, Fe) and other plastic contaminants can be prepared by the present process, utilizing proper selection of petroleum feedstock and filtration. The blends are essentially metals free except for trace amounts of Al, Ca, Si, and Ti that come from typical filler materials for plastic material manufacturing. These filler materials are in inert oxide forms and are not expected to affect the catalyst performance of the conversion unit.

Example 7: Removal of PVC Contaminant by Solubility and Filtration

To study the impact of PVC contamination in waste plastic sourcing, a blend was prepared with addition of pure PVC at 0.5 wt % (Plastic F in Table 1) in addition to 5 wt % of Recycled Waste Plastic #3. This simulation corresponds to 10% of plastic is contaminated with PVC, which could be far worse than the likely commercial recycling of PE and PP. The blend was prepared using an autoclave followed by 0.7-micron filtration per procedure in Example 5 and the results are summarized in Table 8 along with a couple of reference cases.

TABLE 8

Preparation for Stable Blend of Waste Plastic and VGO with Minimal PVC Contamination

| Example | Wt % of Recycled Waste Plastic (WP #) in blend | Dissolution Temp, ° F. | Filtration Pore size, μ | Heptane Insoluble, wt % | Chloride, ppm |
|---|---|---|---|---|---|
| Example 5-1 | VGO only (base case) | No | No | 0.01 | <1 |
| Example 5-7 | 5 wt % WP #3 | 400 | 0.7 | 4.2 | 12 |
| Example 7-1 | 5 wt % WP #3 + 0.5 wt % PVC | 300 | 0.7 | — | 26 |

These Pure VGO has chlorides below the detection level of 1 ppm (Example 5-1). The as-prepared blend with Waste Plastic #3 has 12 ppm chlorides after filtration with 0.7-micron filter (Example 5-7). When 0.5 wt % of PVC is added, we found that PVC does not dissolve in VGO and mostly stays as solids. Upon filtration, the chloride content of the final blend is 26 ppm, only a very minor increase from the reference case of Example 5-7 with 12 ppm chloride. This clearly shows that filtration is a very effective way to reduce the PVC contamination during the blend preparation.

These examples clearly show that with proper selection of petroleum feedstock, for example VGO, one can prevent undesirable PVC from dissolving into the blend, with the PVC then being filtered out.

Example 8: Further Reduction of Chloride Impurity Reduction by Thermal Treatment The blend in Example 7-1 was treated to lower the chloride content further. The stable blend 7.1 was treated in an autoclave via three different ways. The first treatment was a thermal treatment at 650° F. with no purge gas for 1 hour (Example 8-1). The second treatment was a thermal treatment at 650° F. with $N_2$ purge gas for 1 hour (Example 8-2). The third treatment was a thermal treatment at 650° F. with $H_2$ purge gas for 1 hour (Example 8-3). The purge gas rate was 10 sccm/g of blend. The results are summarized in Table 9.

TABLE 9

Further Reduction of Chlorides with Thermal Treatment

| Example | Wt % of Recycled Waste Plastic (WP #) in blend | Dissolution Temp, ° F. | Purge Gas | Treating Temperature, ° F. | Chloride, ppm |
|---|---|---|---|---|---|
| Example 7-1 | 5 wt % WP #3 + 0.5 wt % PVC | 350 | None | None | 26 |
| Example 8-1 | Further treating with no gas | — | None | 650 | 10 |
| Example 8-2 | Further treating with $N_2$ | — | $N_2$ | 650 | 4.8 |
| Example 8-3 | Further treating with $H_2$ | — | $H_2$ | 650 | 3.6 |

The results in Table 9 clearly show that one can selectively decompose PVC by choosing an appropriate temperature for the blend preparation to force decomposition of PVC while maintaining PE and PP intact. By simply treating at an elevation temperature of 650° F., the chloride content was lowered from 26 ppm to 10 ppm (Example 8-1). Use of purge gas such as $N_2$ and $H_2$ further lower the chloride contents to 4.8 and 3.6 ppm (Examples 8-2 and 8-3). Any stripping gas such as nitrogen, hydrogen, steam, or offgas from a conversion unit may be added to facilitate purging of HCl offgas from the decomposition of PVC or organic chlorides in the blend. Hydrogen may be a preferred stripping gas as it facilitates HCl formation and minimizes diene formation.

As used in this disclosure the word "comprises" or "comprising" is intended as an open-ended transition meaning the inclusion of the named elements, but not necessarily excluding other unnamed elements. The phrase "consists essentially of" or "consisting essentially of" is intended to mean the exclusion of other elements of any essential significance to the composition. The phrase "consisting of" or "consists of" is intended as a transition meaning the exclusion of all but the recited elements with the exception of only minor traces of impurities.

All patents and publications referenced herein are hereby incorporated by reference to the extent not inconsistent herewith. It will be understood that certain of the above-described structures, functions, and operations of the above-described embodiments are not necessary to practice the present invention and are included in the description simply for completeness of an exemplary embodiment or embodiments. In addition, it will be understood that specific structures, functions, and operations set forth in the above-described referenced patents and publications can be practiced in conjunction with the present invention, but they are not essential to its practice. It is therefore to be understood that the invention may be practiced otherwise that as specifically described without actually departing from the spirit and scope of the present invention as defined by the appended claims.

What is claimed is:

1. A process for preparing a blend of plastic and petroleum comprising:

(a) mixing a petroleum feed and a plastic comprising polyethylene and/or polypropylene together and while mixing heating the mixture above the melting point of the plastic, while maintaining the temperature less than 500° F.;

(b) recovering a product from step (a) and hot filtering the product to remove contaminants and produce a filtered blend;

(c) heating the filtered blend to a temperature of 550° to 700° F. (288° to 371° C.) to thereby decompose PVC to produce a liquid product; and (d) optionally treating the liquid product with a chloride removal guard bed catalyst.

2. The process of claim 1, wherein the heating of the filtered blend is conducted at a temperature of 550°-700° F. (288° to 371° C.) with a residence time of 5-240 minutes at a final heating temperature.

3. The process of claim 1, wherein the heating is conducted while stripping the liquid using a gas such as nitrogen, hydrogen, steam, or light offgas from a conversion unit.

4. A process for preparing a blend of plastic and petroleum comprising:

a) mixing a petroleum feed and a plastic comprising polyethylene and/or polypropylene together and while mixing heating the mixture above the melting point of the plastic, while maintaining the temperature less than 500° F.;

b) recovering a product from step (a) and hot filtering the product to remove contaminants and produce a filtered blend; and c) treating the liquid product with a chloride removal guard bed catalyst at a temperature of 250° to 700° F. (121° to 371° C.) to thereby decompose PVC to produce a liquid product.

5. The process of claim 4, wherein the treating is conducted at a temperature of 250°-700° F. (121° to 371° C.) with a residence time of 5-240 minutes at a final treating temperature.

6. The process of claim 1, wherein the amount of plastic mixed with the petroleum feed ranges from 1-20 wt. % of the blend.

7. The process of claim 1, wherein the amount of plastic in the blend comprises from 1-10 wt. % of the blend.

8. The process of claim 1, wherein the plastic comprises low density polyethylene.

9. The process of claim 1, wherein the plastic comprises high density polyethylene.

10. The process of claim 1, wherein the plastic comprises multi-layer films comprising a metal barrier layer, polyethylene and/or polypropylene.

11. The process of claim 10, wherein the metal barrier layer is comprised of aluminum.

12. The process of claim 1, wherein the blend comprises from 1-10 wt. % of the high density polyethylene.

13. The process of claim 1, wherein the plastic comprises polypropylene having an average molecular weight, $M_w$, in the range of 5,000 to 150,000.

14. The process of claim 1, wherein the plastic comprises polypropylene having an average molecular weight, $M_w$, in the range of 150,000 to 400,000.

15. The process of claim 4, wherein the amount of plastic mixed with the petroleum feed ranges from 1-20 wt. % of the blend.

16. The process of claim 4, wherein the amount of plastic in the blend comprises from 1-10 wt. % of the blend.

17. The process of claim 4, wherein the plastic comprises low density polyethylene.

18. The process of claim 4, wherein the plastic comprises high density polyethylene.

19. The process of claim 4, wherein the plastic comprises multi-layer films comprising a metal barrier layer, polyethylene and/or polypropylene.

20. The process of claim 19, wherein the metal barrier layer is comprised of aluminum.

21. The process of claim 4, wherein the blend comprises from 1-10 wt. % of the high density polyethylene.

22. The process of claim 4, wherein the plastic comprises polypropylene having an average molecular weight, $M_w$, in the range of 5,000 to 150,000.

23. The process of claim 4, wherein the plastic comprises polypropylene having an average molecular weight, $M_w$, in the range of 150,000 to 400,000.

* * * * *